US008057565B2

(12) United States Patent
Yabu et al.

(10) Patent No.: US 8,057,565 B2
(45) Date of Patent: Nov. 15, 2011

(54) AIR CONDITIONING APPARATUS

(75) Inventors: Tomohiro Yabu, Sakai (JP); Tetsuya Morizane, Sakai (JP); Toshiyuki Nishio, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 446 days.

(21) Appl. No.: 12/300,411

(22) PCT Filed: May 11, 2007

(86) PCT No.: PCT/JP2007/059711

§ 371 (c)(1),
(2), (4) Date: Nov. 11, 2008

(87) PCT Pub. No.: WO2007/132752

PCT Pub. Date: Nov. 22, 2007

(65) Prior Publication Data

US 2009/0165432 A1 Jul. 2, 2009

(30) Foreign Application Priority Data

May 15, 2006 (JP) ..... 2006-134778

(51) Int. Cl.
*B01D 46/00* (2006.01)

(52) U.S. Cl. ..... 55/378; 55/385.2; 55/415; 55/417; 55/418; 55/478; 55/480; 55/481; 55/490; 55/494; 55/506

(58) Field of Classification Search ..... 55/378, 55/385.2, 415, 417–418, 478, 480–481, 490, 55/494, 506

See application file for complete search history.

(56) References Cited

U.S. PATENT DOCUMENTS

| | | | | |
|---|---|---|---|---|
| 2,575,499 | A * | 11/1951 | Manow | 55/422 |
| 5,863,310 | A * | 1/1999 | Brown et al. | 55/480 |
| 6,174,342 | B1 * | 1/2001 | Jeanseau | 55/385.2 |
| 6,527,838 | B2 * | 3/2003 | Volo et al. | 96/134 |
| 7,670,414 | B2 * | 3/2010 | Cha et al. | 96/398 |
| 2007/0113527 | A1 * | 5/2007 | Song et al. | 55/471 |

FOREIGN PATENT DOCUMENTS

| | | | |
|---|---|---|---|
| JP | H02-116622 | U | 9/1990 |
| JP | H02-233920 | A | 9/1990 |
| JP | H05-040726 | U | 6/1993 |
| JP | H08-312991 | A | 11/1996 |
| JP | H09-014744 | A | 1/1997 |
| JP | H10-196998 | A | 7/1998 |
| JP | 2001-263715 | A | 9/2001 |
| JP | 2003-194394 | A | 7/2003 |
| JP | 2006-023029 | A | 1/2006 |
| JP | 2006-071136 | A | 3/2006 |

* cited by examiner

*Primary Examiner* — Jason M Greene
*Assistant Examiner* — Dung H Bui
(74) *Attorney, Agent, or Firm* — Global IP Counselors

(57) ABSTRACT

An air conditioning apparatus is disposed above an air conditioned space. The air conditioning apparatus includes a case, a bottom surface panel, a filter, and a filter support part. The bottom surface of the case is open. The bottom surface panel covers part of the open portion of the bottom surface of the case. The filter is accommodated within the case. The filter support part detachably supports the filter such that the filter is separated upward from the bottom surface panel by a predetermined gap.

30 Claims, 10 Drawing Sheets

AIR CONDITIONING APPARATUS

CROSS-REFERENCE TO RELATED APPLICATIONS

This U.S. National stage application claims priority under 35 U.S.C. §119(a) to Japanese Patent Application No. 2006-134778, filed in Japan on May 15, 2006, the entire contents of which are hereby incorporated herein by reference.

TECHNICAL FIELD

The present invention relates to an air conditioning apparatus, and particularly to an air conditioning apparatus disposed above an air conditioned space.

BACKGROUND ART

Conventionally, a ceiling-embedded air conditioning apparatus has been proposed in which a flat panel and a filter are integrally and automatically raised and lowered by wires in order to easily clean and replace the filter (see Japanese Laid-open Patent Application No. 10-196998).

SUMMARY OF THE INVENTION

Problems the Invention is Intended to Solve

However, with this type of the ceiling-embedded air conditioning apparatus, since the flat panel and the filter are integrally connected, it is difficult to attach and remove the filter, and labor is required for maintenance work. Another problem is that an air intake channel has not been sufficiently ensured between the flat panel and the filter.

An object of the present invention is to provide an air conditioning apparatus in which a filter is easily replaced and an air intake channel can be sufficiently ensured.

Means for Solving these Problems

The air conditioning apparatus according to a first aspect of the present invention is an air conditioning apparatus disposed above an air conditioned space. The air conditioning apparatus comprises a case, a bottom surface panel, a filter, and a filter support part. The bottom surface of the case is open. The bottom surface panel covers part of the open portion of the bottom surface of the case. The filter is accommodated within the case. The filter support part detachably supports the filter such that the filter is separated upward from the bottom surface panel by a predetermined gap.

Since the ceiling-embedded air conditioning apparatus herein comprises the filter support part for detachably supporting the filter such that the filter is separated upward from the bottom surface panel by the predetermined gap, the filter can be opened together with the bottom surface panel, and the filter can be readily replaced. Moreover, it is possible to sufficiently ensure an air intake channel between the filter and the bottom surface panel by separating the filter upward from the bottom surface panel by the predetermined gap by means of the filter support part.

The air conditioning apparatus according to a second aspect of the present invention is the air conditioning apparatus according to the first aspect of the present invention, wherein the filter support part is detachably connected to the bottom surface panel.

Since the filter support part is herein detachably connected to the bottom surface panel, it is possible to readily attach and remove the bottom surface panel to and from the filter support part, and to open the bottom surface panel. The result is that the filter can be even more readily cleaned and replaced. The bottom surface panel can be readily cleaned and replaced.

The air conditioning apparatus according to a third aspect of the present invention is the air conditioning apparatus according to the first or second aspect of the present invention, further comprising a bottom surface panel raising/lowering mechanism. The bottom surface panel raising/lowering mechanism raises and lowers the bottom surface panel together with the filter and the filter support part.

Since the air conditioning apparatus further comprises the bottom surface panel raising/lowering mechanism for raising and lowering the bottom surface panel together with the filter and the filter support part, the bottom surface panel and the filter can be lowered to a height manageable for a worker, whereby the filter can be readily cleaned and replaced.

The air conditioning apparatus according to a fourth aspect of the present invention is the air conditioning apparatus according to the third aspect of the present invention, further comprising moveable panels for opening and closing ventilation ports formed between the bottom surface of the case and the bottom surface panel. The bottom surface panel raising/lowering mechanism raises and lowers the bottom surface panel together with the moveable panels, the filter, and the filter support part.

Since the air conditioning apparatus herein further comprises the moveable panels for opening and closing ventilation ports formed between the bottom surface of the case and the bottom surface panel, and the bottom surface panel raising/lowering mechanism raises and lowers the bottom surface panel together with the moveable panels, the filter, and the filter support part, the filter can be opened together with the bottom surface panel and the moveable panels, and it is even easier to replace the filter.

The air conditioning apparatus according to a fifth aspect of the present invention is the air conditioning apparatus according to the fourth aspect of the present invention, wherein the bottom surface panel raising/lowering mechanism lowers the bottom surface panel after the moveable panels have opened.

Since the bottom surface panel raising/lowering mechanism lowers the bottom surface panel after the moveable panels have opened, it is possible to prevent the inconvenience of the moveable panels being caught on the bottom surface of the case.

The air conditioning apparatus according to a sixth aspect of the present invention is the air conditioning apparatus according to any of the third through fifth aspects of the present invention, wherein the bottom surface panel raising/lowering mechanism raises/lowers and tilts the bottom surface panel.

Since the bottom surface panel raising/lowering mechanism raises/lowers and tilts the bottom surface panel, it is possible to incline the filter together with the bottom surface panel, and it is even easier to clean and replace the filter.

The air conditioning apparatus according to a seventh aspect of the present invention is the air conditioning apparatus according to the sixth aspect of the present invention, wherein the filter support part has fall-prevention parts. The fall-prevention parts prevent the filter from falling when the bottom surface panel has been inclined.

Since the filter support part has fall-prevention parts, it is possible to prevent the filter from falling when the bottom surface panel has been inclined.

The air conditioning apparatus according to an eighth aspect of the present invention is the air conditioning apparatus according to any of the first through seventh aspects of the present invention, wherein the filter support part has a structure that allows the filter to be removed from above.

Since the filter support part has the structure that allows the filter to be removed from above, the filter can easily be removed from above.

The air conditioning apparatus according to a ninth aspect of the present invention is the air conditioning apparatus according to any of the first through eighth aspects of the present invention, wherein the filter support part has a structure that allows the filter to be removed from below.

Since the filter support part has the structure that allows the filter to be removed from below, the filter can easily be removed from below.

The air conditioning apparatus according to a tenth aspect of the present invention is the air conditioning apparatus according to any of the first through ninth aspects of the present invention, wherein the filter support part has a structure that allows the filter to be slid and removed laterally.

Since the filter support part has the structure that allows the filter to be slid and removed laterally, the filter can be attached and removed easily.

The air conditioning apparatus according to an eleventh aspect of the present invention is the air conditioning apparatus according to the first or second aspect of the present invention, further comprising a rotational opening/closing mechanism and filter-raising/lowering mechanism. The rotational opening/closing mechanism rotates and opens/closes the bottom surface panel downward in the bottom surface of the case. The filter-raising/lowering mechanism detaches the filter from the bottom surface panel and raises/lowers the filter.

Since the air conditioning apparatus herein further comprises the rotational opening/closing mechanism for rotating and opening/closing the bottom surface panel downward in the bottom surface of the case, and the filter-raising/lowering mechanism for detaching the filter from the bottom surface panel and raising/lowering the filter, it is possible to raise and lower the filter alone, and it is even easier to clean and replace the filter.

The air conditioning apparatus according to a twelfth aspect of the present invention is the air conditioning apparatus according to any of the first through eleventh aspects of the present invention, wherein the ventilation ports are disposed around the periphery of the bottom surface panel in the case, at two opposing locations on opposite sides of the bottom surface panel.

Since the ventilation ports are herein disposed around the periphery of the bottom surface panel in the case, at two opposing locations on opposite sides of the bottom surface panel, air can be drawn in and blown out in two directions in the room, and drafty feeling (breezy feeling) can be suppressed, making cooling, warming, and other types of air conditioning possible throughout the entire room.

The air conditioning apparatus according to a thirteenth aspect of the present invention is the air conditioning apparatus according to any of the first through eleventh aspects of the present invention, wherein the ventilation ports are disposed around the entire periphery of the bottom surface panel in the case.

Since the ventilation ports are herein disposed around the entire periphery of the bottom surface panel in the case, air can be drawn in and blown out respectively in all directions in the room, and drafty feeling (breezy feeling) can be suppressed further, making cooling, warming, and other types of air conditioning possible throughout the entire room.

EFFECT OF THE INVENTION

According to the first aspect of the present invention, the filter can be opened together with the bottom surface panel, and it is easy to replace the filter. Moreover, it is possible to sufficiently ensure an air intake channel between the filter and the bottom surface panel by separating the filter upward from the bottom surface panel by a predetermined gap by means of the filter support part.

According to the second aspect of the present invention, it is possible to easily attach and remove the bottom surface panel to and from the filter support part, and to open the bottom surface panel. The result is that it is even easier to clean and replace the filter. It is also easy to clean and replace the bottom surface panel.

According to the third aspect of the present invention, the bottom surface panel and the filter can be lowered to a height manageable for a worker, whereby the filter can be easily cleaned and replaced.

According to the fourth aspect of the present invention, the filter can be opened together with the bottom surface panel and the moveable panels, and it is even easier to replace the filter.

According to the fifth aspect of the present invention, it is possible to prevent the inconvenience of the moveable panels being caught on the bottom surface of the case.

According to the sixth aspect of the present invention, it is possible to incline the filter together with the bottom surface panel, and it is even easier to clean and replace the filter.

According to the seventh aspect of the present invention, it is possible to prevent the filter from falling when the bottom surface panel has been inclined.

According to the eighth aspect of the present invention, the filter can easily be removed from above.

According to the ninth aspect of the present invention, the filter can easily be removed from below.

According to the tenth aspect of the present invention, the filter can be attached and removed easily.

According to the eleventh aspect of the present invention, it is possible to raise and lower the filter alone, and it is even easier to clean and replace the filter.

According to the twelfth aspect of the present invention, air can be drawn in and blown out in two directions in the room, and drafty feeling (breezy feeling) can be suppressed, making cooling, warming, and other types of air conditioning possible throughout the entire room.

According to the thirteenth aspect of the present invention, air can be drawn in and blown out in all directions in the room, and drafty feeling (breezy feeling) can be suppressed further, making cooling, warming, and other types of air conditioning possible throughout the entire room.

DETAILED DESCRIPTION OF THE INVENTION

First Embodiment

Figure 1:
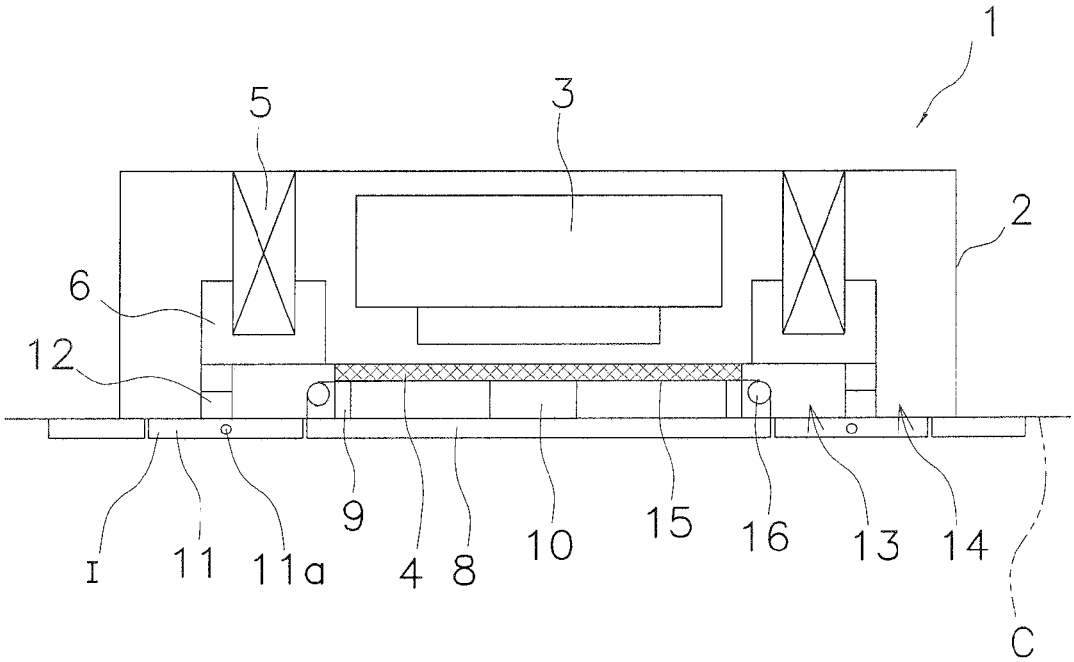
FIG. 1 is a cross-sectional view of a closed state of the moveable panels of a ceiling-installed air conditioning apparatus according to the first embodiment of the present invention.

<Basic Configuration of Air Conditioning Apparatus 1>

The ceiling-installed air conditioning apparatus 1 according to the first embodiment of the present invention is disposed in a state of being embedded in a ceiling C above a room or another such air conditioned space, as shown in FIGS. 1 through 6. The air conditioning apparatus 1 is configured primarily from a case 2, an air-blowing fan 3, a filter 4, a heat exchanger 5, a drain pan 6, a flat panel 8, a filter support part 9, a flat panel raising/lowering mechanism 10, moveable panels 11, and a moveable-panel moving mechanism 12.

The case 2 is inserted and disposed in an opening formed in the ceiling C of the room. Disposed inside the case 2 are, primarily, the air-blowing fan 3 for drawing air in the room into the case 2 and blowing the air peripherally outward, the filter 4 for filtering the air drawn into the case 2, and the heat exchanger 5 disposed so as to enclose the external periphery of the air-blowing fan 3.

The case 2 of the air conditioning apparatus 1 is disposed so as to fit into the opening of the ceiling C. The case 2 may also be disposed by being suspended from the surface of the ceiling C.

The air-blowing fan 3 is configured from a turbofan or another such centrifugal fan, in which the air in the room is drawn into the case 2 through suction ports 3 of the case 2, and an air flow is generated for blowing conditioned air out from discharge ports 14 after the air is filtered by the filter 4. The air drawn in through the suction ports 13 flows through the air-blowing fan 3 to the heat exchanger 5. In the heat exchanger 5, the air undergoes heat exchange with a refrigerant and is cooled or heated to create conditioned air. The conditioned air then flows along the inside surfaces of the case 2, and the air is then blown out through the discharge ports 14 into the room or other air-conditioned space.

The drain pan 6 for receiving drain water produced by condensation of moisture in the air in the heat exchanger 5 is disposed underneath the heat exchanger 5.

The flat panel 8 is a panel made of a synthetic resin for covering part of the open portion of the bottom surface of the case 2, and the flat panel 8 corresponds to the bottom surface flat panel of the present invention. A pair of hooks 8*a* (see FIGS. 5 and 6) are formed at the ends of the flat panel 8.

Also formed at the sides of the flat panel 8 is a pair of the suction ports 13 for drawing in the air in the room. Furthermore, a pair of the discharge ports 14 for blowing out conditioned air into the room from the case 2 interior is formed in the outer sides of the pair of the suction ports 13. The discharge ports 14 may be provided with flaps for adjusting the angles at which conditioned air is blown out.

Figure 2:
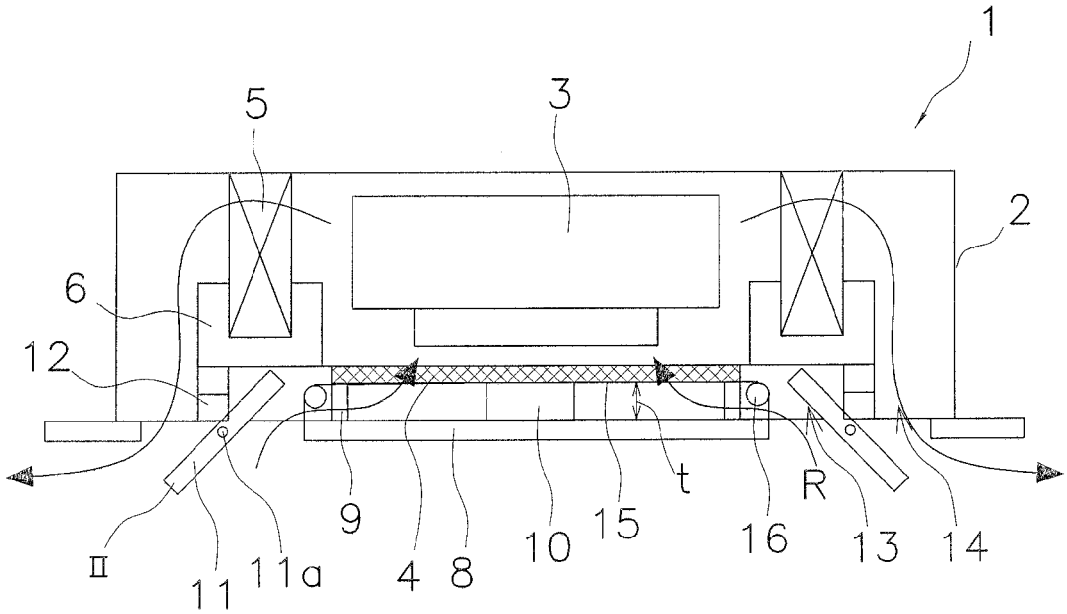
FIG. 2 is a cross-sectional view of an open state of the moveable panels of the air conditioning apparatus in FIG. 1.
Figure 3:
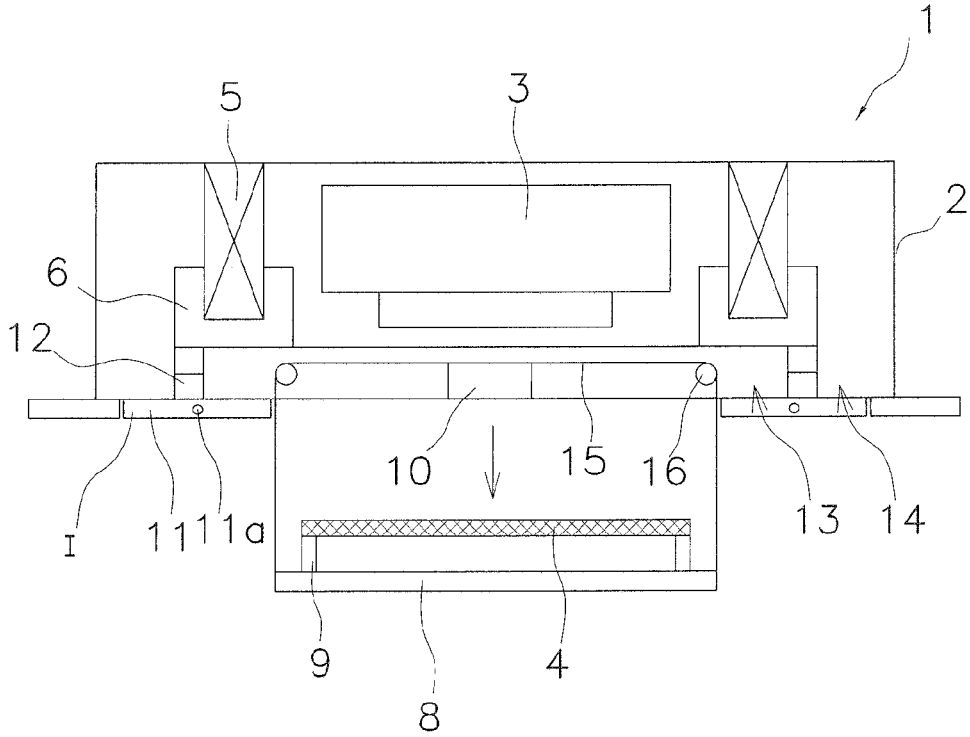
FIG. 3 is a cross-sectional view of a lowered state of the filter and the flat panel of the air conditioning apparatus in FIG. 1.
Figure 4:
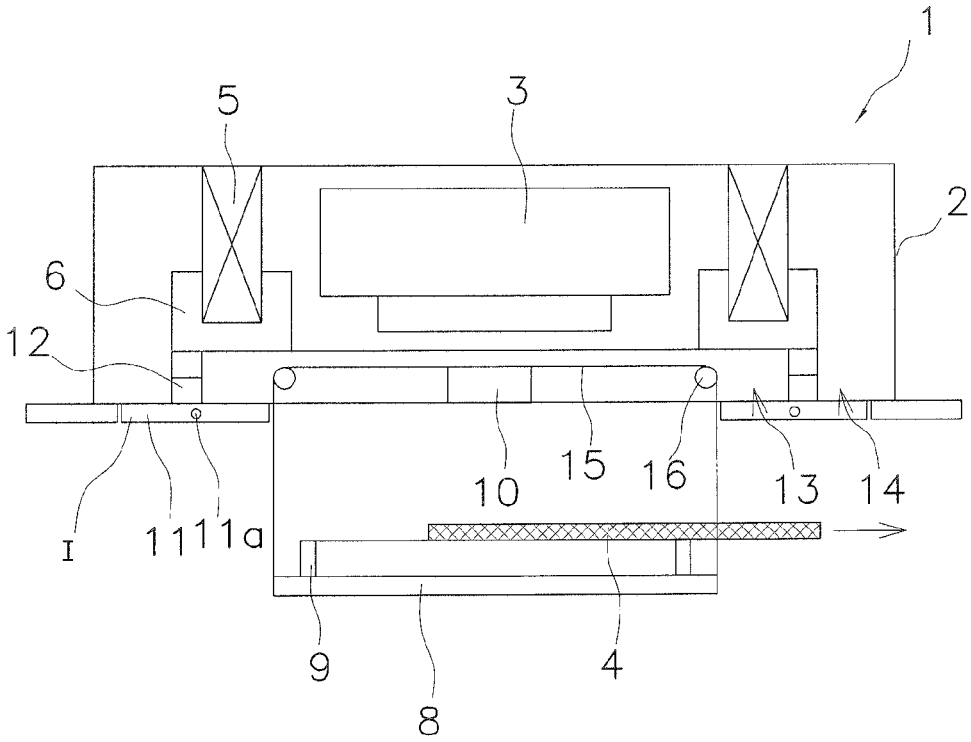
FIG. 4 is a cross-sectional view of a state in which the filter of the air conditioning apparatus in FIG. 1 is being removed.

The filter support part 9 detachably supports the filter 4 such that the filter 4 is separated upward from the flat panel 8 by a predetermined gap t (see FIG. 2). Since the filter 4 is separated upward from the flat panel 8 by the predetermined gap t, it is possible to sufficiently ensure an air intake channel R.

Figure 5:
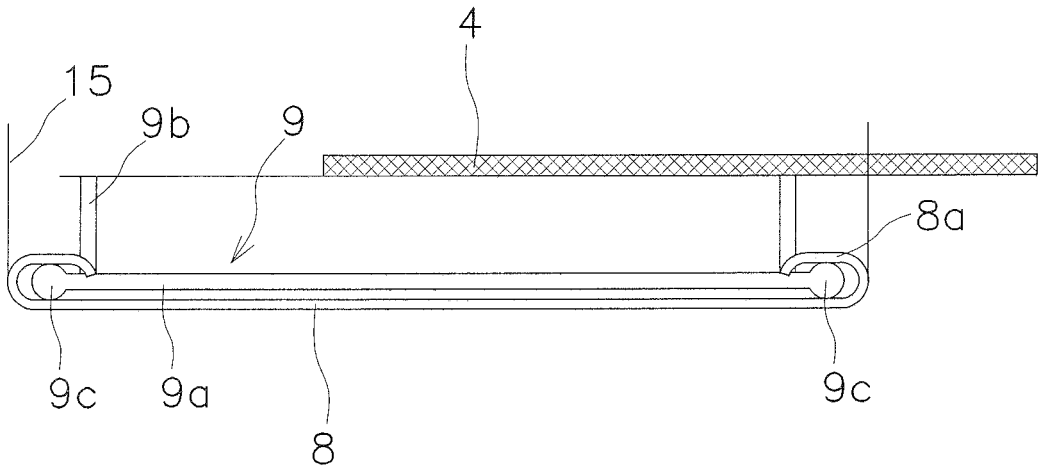
FIG. 5 is an enlarged cross-sectional view of the vicinity of the flat panel in a state in which the filter in FIG. 4 is being removed.
Figure 6:
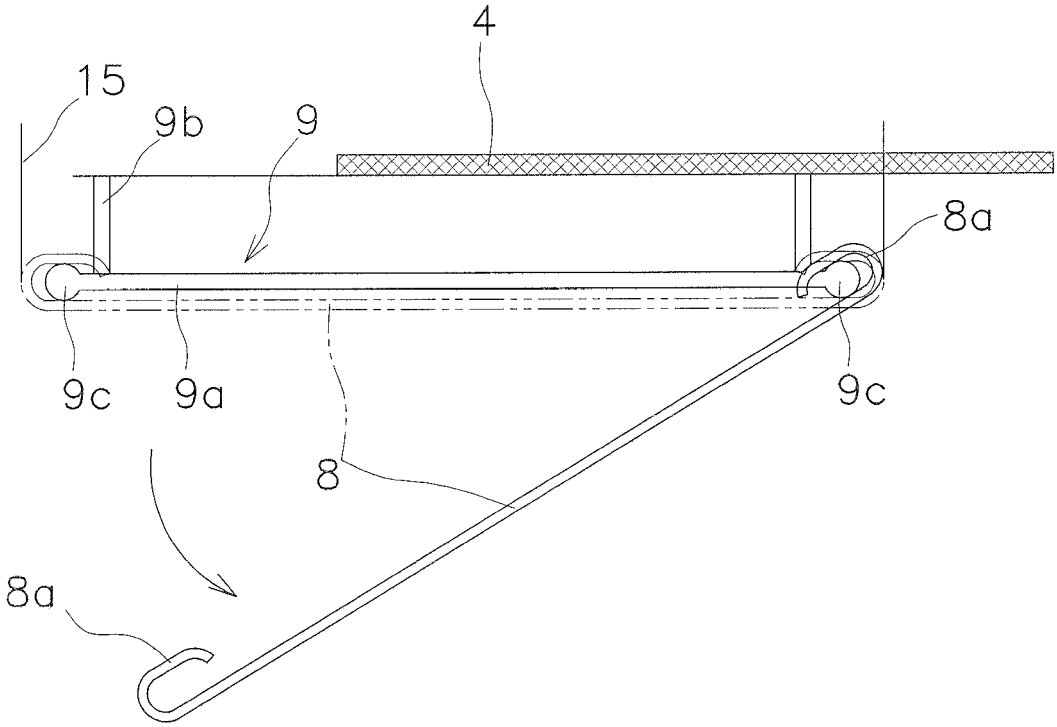
FIG. 6 is an enlarged cross-sectional view of a state in which the flat panel in FIG. 5 is being removed.

The filter support part 9 detachably supports the filter 4 such that the filter 4 is separated upward from the flat panel 8 by the predetermined gap t. The filter support part 9 has a pedestal 9*a*, support parts 9*b* for supporting the filter 4 from below, and protuberances 9*c*, as shown in FIGS. 5 and 6. The filter support part 9 detachably supports the filter 4 such that the support parts 9*b* and the frame portion of the filter 4 fit together and the like.

Moreover, the filter support part 9 is detachably connected to the flat panel 8 as shown in FIGS. 5 and 6. The pair of hooks 8*a* formed at the ends of the flat panel 8 detachably fit with the protuberances 9*c* of the filter support part 9, whereby the flat panel 8 can be easily attached and removed. The flat panel 8 can also be opened up to expose the filter 4, and as a result, it is therefore even easier to clean and replace the filter 4.

The flat panel raising/lowering mechanism 10 raises and lowers the flat panel 8 together with the filter 4 and the filter support part 9. The flat panel raising/lowering mechanism 10 has a motor and a reduction mechanism inside the main body thereof, and the mechanism raises and lowers the flat panel 8 by moving wires 15 back and forth, the wires being connected to the ends of the flat panel 8. The flat panel raising/lowering mechanism 10 is fixed to a frame (not shown) in the interior of the case 2. The wires 15 are extended by a pulley 16 provided in the case 2 interior, in a manner that allows the wires to move back and forth within the case 2.

The pair of moveable panels 11 are flat plate-shaped members manufactured from a synthetic resin or the like respectively, and are disposed on the both sides of the flat panel 8. The moveable panels 11 open and close the suction ports 13 and the discharge ports 14.

The moveable-panel moving mechanism 12 is a mechanism for moving the moveable panels 11 between first positions I and second positions II, as shown in FIGS. 1 and 2. The moveable-panel moving mechanism 12 is configured from step motors or the like, for example, and is fixed in the case 2 interior. When the air conditioning apparatus 1 begins to operate, the moveable-panel moving mechanism 12 rotatably moves the moveable panels 11 from the first positions I to the second positions II, the second positions being inclined by predetermined angles in relation to the ceiling C, and the suction ports 13 and discharge ports 14 are opened. When the air conditioning apparatus 1 stops operating, the moveable panels 11 are rotatably moved from the second positions II to the first positions I, and the suction ports 13 and discharge ports 14 are closed.

<Characteristics of First Embodiment>

(1)

Since the ceiling-embedded air conditioning apparatus 1 disposed in the ceiling C above the room in the first embodiment comprises the case 2 whose bottom surface is opened, the flat panel 8 for covering part of the open portion in the bottom surface of the case 2, the filter 4 accommodated within the case 2, and the filter support part 9 for detachably supporting the filter 4 such that the filter 4 is separated upward from the flat panel 8 by the predetermined gap t, the filter 4 can be opened together with the flat panel 8, and it is easy to replace the filter 4. Moreover, the filter 4 is separated upward from the flat panel 8 by the predetermined gap t by the filter support part 9, whereby an air intake channel R can be sufficiently ensured between the filter 4 and the flat panel 8.

(2)

In the air conditioning apparatus 1 of the first embodiment, since the filter support part 9 is detachably connected to the flat panel 8, the flat panel 8 can easily be attached to and removed from the filter support part 9, and the flat panel 8 can be opened up. The result is that it is even easier to clean and replace the filter 4. The flat panel 8 can also be easily cleaned and replaced.

(3)

Since the air conditioning apparatus 1 of the first embodiment further comprises the flat panel raising/lowering mechanism 10 for raising and lowering the flat panel 8 together with the filter 4 and the filter support part 9, the flat panel 8 and the filter 4 can be lowered to a height manageable for a worker, whereby the filter 4 can be easily cleaned and replaced.

(4)

In the air conditioning apparatus 1 of the first embodiment, since the suction ports 13 and the discharge ports 14, which are ventilation ports, are disposed in two locations facing each other across the flat panel 8 in the periphery of the flat panel 8 in the case 2 (a so-called double-flow arrangement), air can be drawn in and blown out in two directions respectively in the room, and drafty feeling (breezy feeling) can be suppressed, making cooling, warming, and other types of air conditioning possible throughout the entire room.

<Modifications of First Embodiment)

(A)

Figure 7:
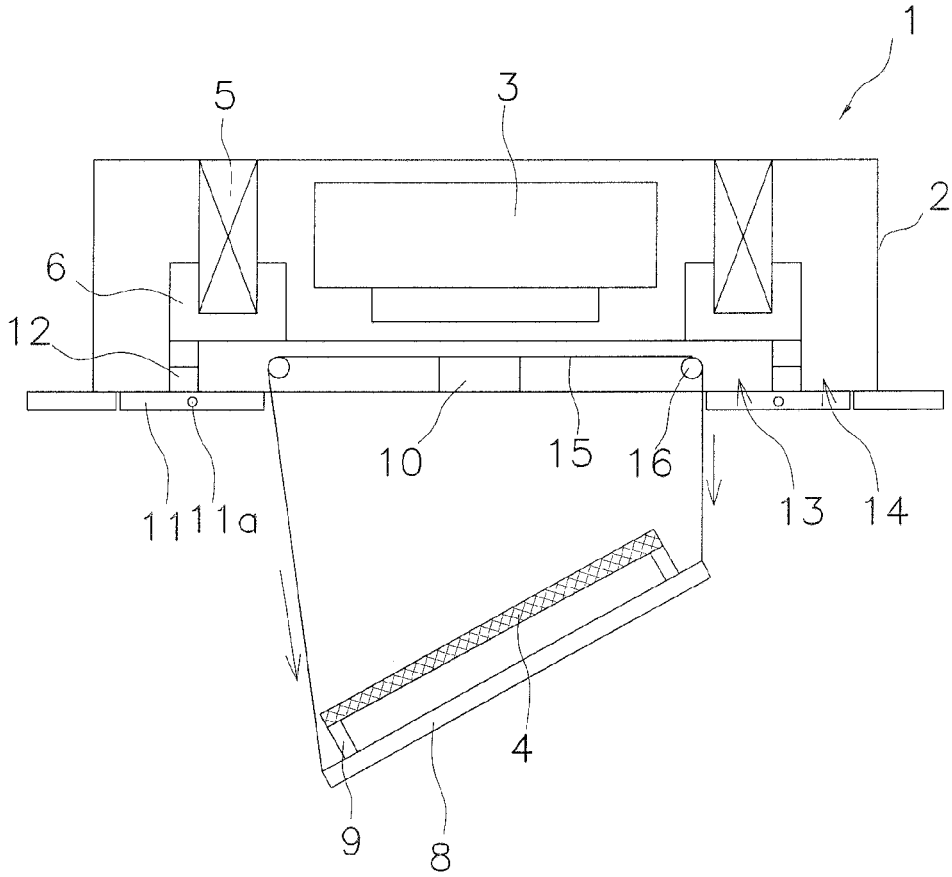
FIG. 7 is a cross-sectional view of a lowered and tilted state of the filter and flat panel according to a modification of the first embodiment of the present invention.

In the air conditioning apparatus 1 of the first embodiment, the flat panel raising/lowering mechanism 10 merely raises and lowers the flat panel 8 (as well as the filter support part 9 and the filter 4) vertically, but the present invention is not limited to this option alone. As a modification of the first embodiment, the flat panel raising/lowering mechanism 10 may raise/lower and tilt the flat panel 8 by changing the feed amounts (strokes) of both wires 15, as shown in FIG. 7. In this case, the filter 4 can also be automatically inclined together with the flat panel 8, making it even easier to clean and replace the filter.

(B)

Figure 8:
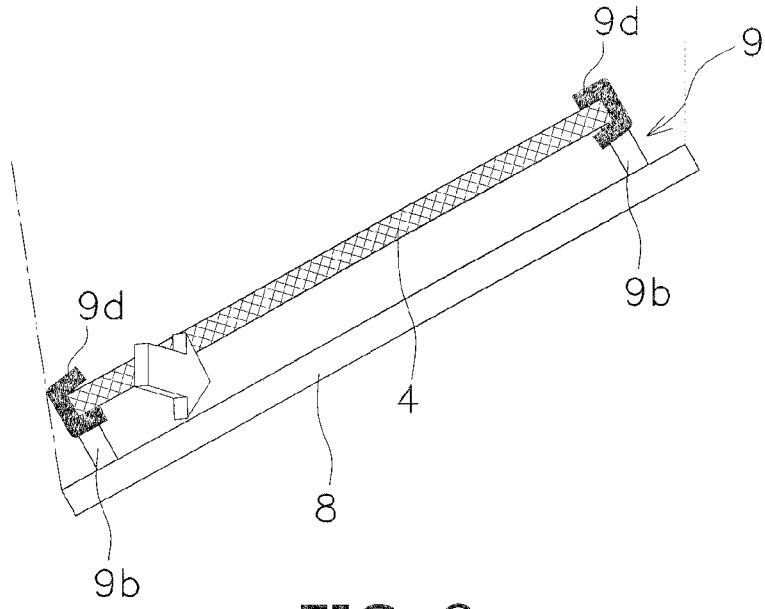
FIG. 8 is an enlarged cross-sectional view of the lowered and tilted state of the filter and flat panel according to another modification of the first embodiment of the present invention.

To hold the filter 4 even when the flat panel 8 is in an inclined position as in Modification (A) described above, in another modification of the first embodiment, it is preferable that the filter support part 9 have a pair of U-shaped portions 9*d*, which have U shapes in cross section, as fall-prevention parts for preventing the filter 4 from falling while the flat panel 8 is inclined, as shown in FIG. 8.

The pair of U-shaped portions 9*d* are disposed so as to face each other, and are configured so as to hold the both side surfaces of the frame portion of the filter 4. Therefore, the filter 4 is held by the pair of U-shaped portions 9*d*, which are fall-prevention parts, even when the flat panel 8 and the filter 4 are inclined to either the left or right, whereby the filter 4 can be prevented from falling.

(C)

In the case of the fall-prevention parts 9*d* composed of a pair of members having U shapes in cross section shown in FIG. 8, the filter 4 can easily be attached and removed by sliding the filter 4 in the direction perpendicular to the paper surface in FIG. 8, from a state in which the filter 4 is held.

(D)

Figure 9:
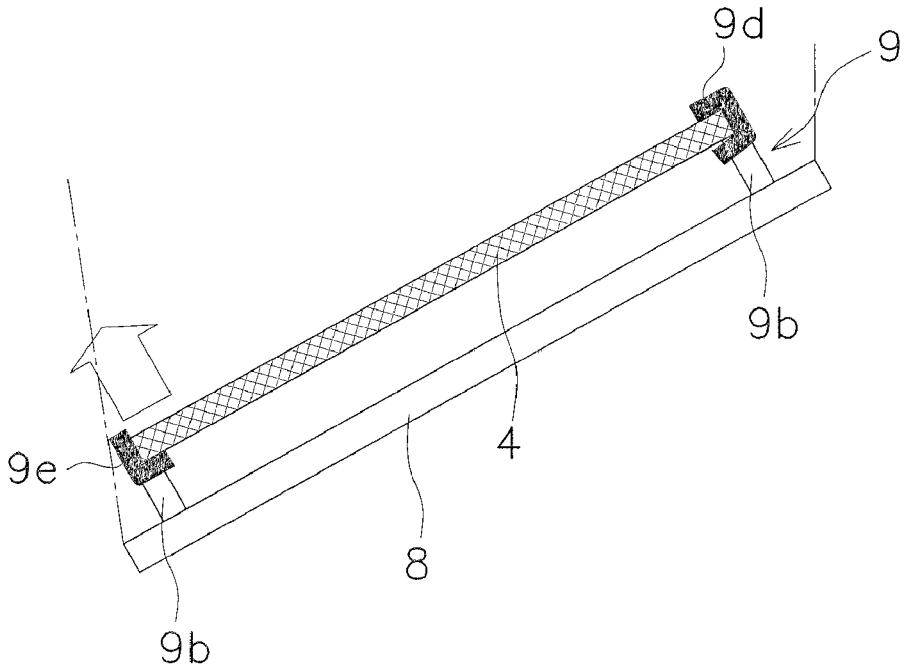
FIG. 9 is an enlarged cross-sectional view of the lowered and tilted state of the filter and flat panel according to yet another modification of the first embodiment of the present invention.

As yet another modification of the first embodiment, it is preferable that the filter support part 9 have a structure that allows the filter 4 to be removed from above so that the filter 4 can be easily attached and removed when the flat panel 8 and the filter 4 have been either lowered or both lowered and inclined, as shown in FIG. 9.

For example, in the filter support part 9 in FIG. 9, a U-shaped portion 9*d* having a U shape in cross section and an L-shaped portion 9*e* having an L shape in cross section are provided facing each other to the respective support parts 9*b* on the both sides. The both side surfaces of the frame portion of the filter 4 are held by the U-shaped portion 9*d* and the L-shaped portion 9*e*, and the filter 4 can therefore be prevented from falling. After the flat panel 8 and the filter 4 are lowered and inclined so that the L-shaped portion 9*e* is lowered, the filter 4 can easily be removed from above by lifting upward the portion of the filter 4 resting on the L-shaped portion 9*e*.

(E)

Figure 10:
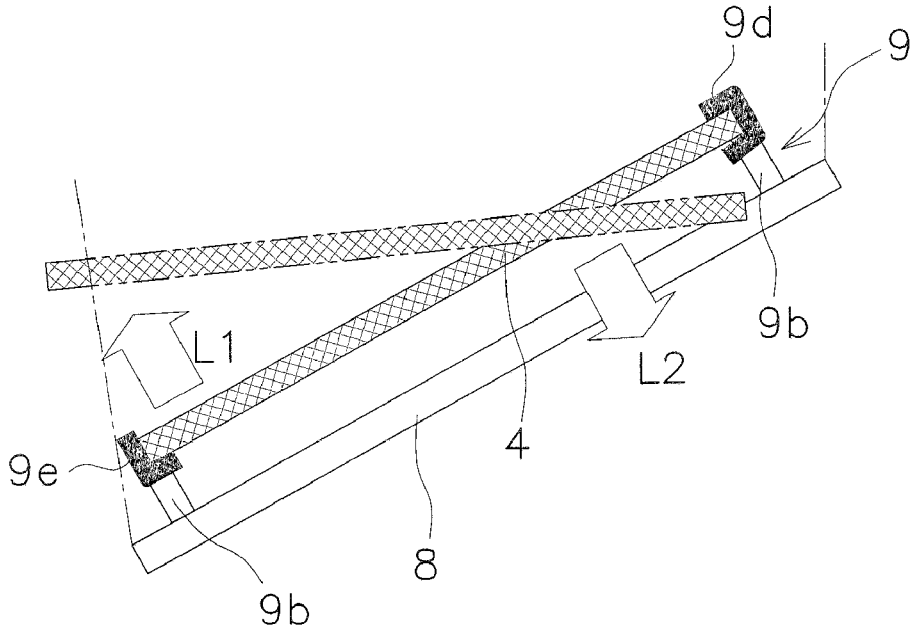
FIG. 10 is an enlarged cross-sectional view of the lowered and tilted state of the filter and flat panel according to yet another modification of the first embodiment of the present invention.

As yet another modification of the first embodiment, it is preferable that the filter support part 9 have a structure that allows the filter 4 to be removed from below so that the filter 4 can be easily attached and removed when the flat panel 8 and the filter 4 have been either lowered or both lowered and inclined, as shown in FIG. 10.

For example, in the filter support part 9 in FIG. 10, a U-shaped portion 9*d* having a U shape in cross section and an L-shaped portion 9*e* having an L shape in cross section are provided to the respective support parts 9*b* on the both sides. Since the both side surfaces of the frame portion of the filter 4 are held by the U-shaped portion 9*d* and the L-shaped portion 9*e*, the filter 4 can be prevented from falling. After the flat panel 8 and the filter 4 are lowered and inclined so that the L-shaped portion 9*e* is lowered, the flat panel 8 can be removed from the filter support part 9 as shown in FIGS. 5 and 6, and after one end of the filter 4 can be lifted up (arrow L1) from the portion resting on the L-shaped portion 9*e*, the other end of the filter 4 can then be removed from the U-shaped portion 9*d*, and lastly the other end of the filter 4 can be removed downward (arrow L2). The filter 4 can thereby be easily removed from below, and the work of removal is even easier than removing the filter from above.

(F)

In the case of the filter support part 9 in FIG. 10, it is not only possible to remove the filter 4 from below, but it is also possible to slide and remove the filter 4 as in Modification (C) described above, and also to remove the filter 4 from above as in Modification (D) described above. Therefore, it is possible to appropriately select from three removal methods for the filter 4, in which there are upward removal, downward removal, and sliding removal methods, in view of the work environment and other factors. Therefore, the work of removing the filter 4 can be performed even more easily.

(G)

Figure 11:
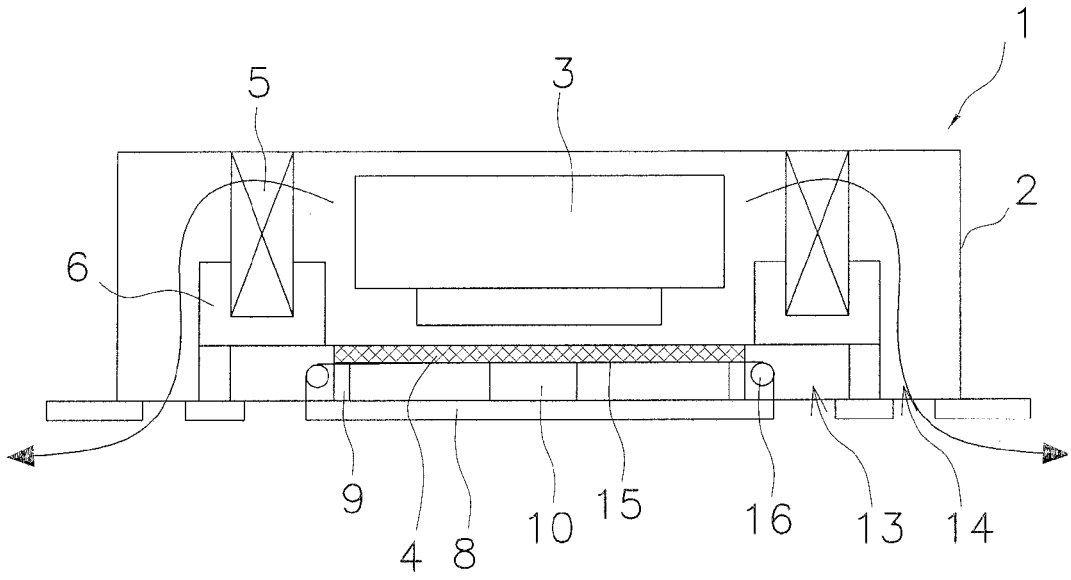
FIG. 11 is a cross-sectional view of an air conditioning apparatus according to yet another modification of the first embodiment of the present invention.

As yet another modification of the first embodiment, even if the moveable panels 11 and moveable-panel moving mechanisms 12 described above are omitted from the air conditioning apparatus 1 as shown in FIG. 11, the filter 4 can still be easily cleaned and replaced by lowering the flat panel 8 and the filter 4 to a height manageable for a worker by means of the flat panel raising/lowering mechanism 10.

(H)

As yet another modification of the first embodiment, a so-called round flow arrangement may be used, wherein the suction ports 13 and discharge ports 14 are disposed around the entire periphery of the flat panel 8 constituting the bottom surface of the case 2.

In this case, air can be drawn in from and blown out in all directions in the room, and drafty feeling (breezy feeling) can be further suppressed, making cooling, warming, and other types of air conditioning possible throughout the entire room.

Second Embodiment

<Basic Configuration of Air Conditioning Apparatus 21>

Figure 12:
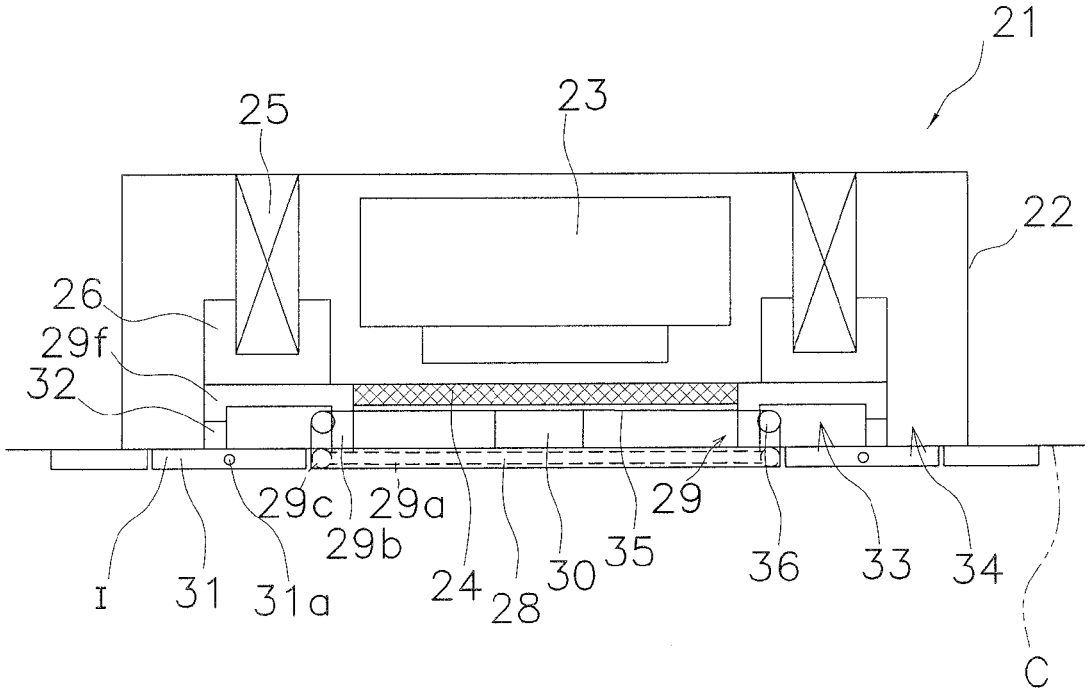
FIG. 12 is a cross-sectional view of a closed state of the moveable panels of the ceiling-installed air conditioning apparatus according to the second embodiment of the present invention.
Figure 13:
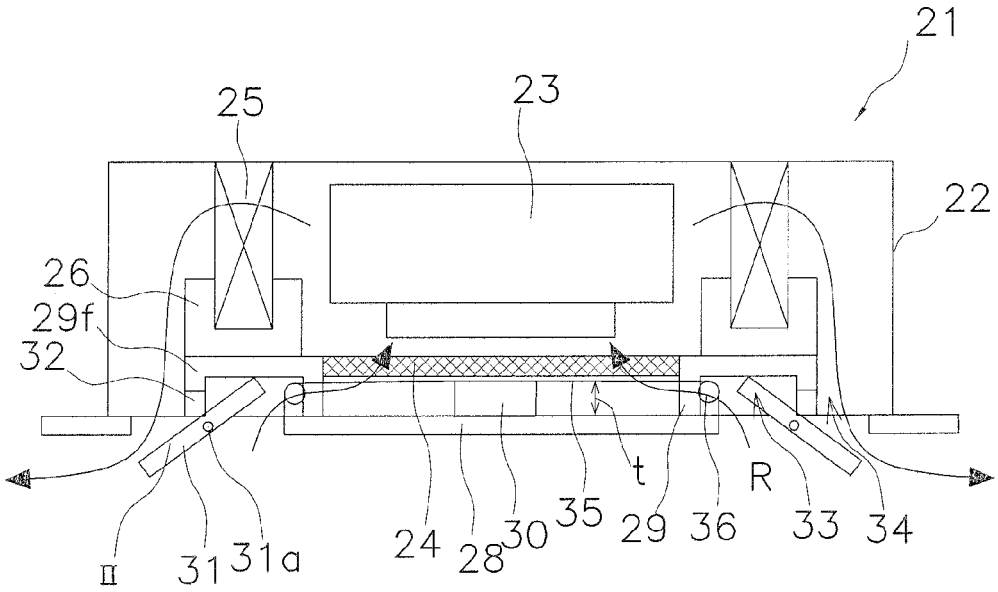
FIG. 13 is a cross-sectional view of an open state of the moveable panels of the air conditioning apparatus in FIG. 12.
Figure 14:
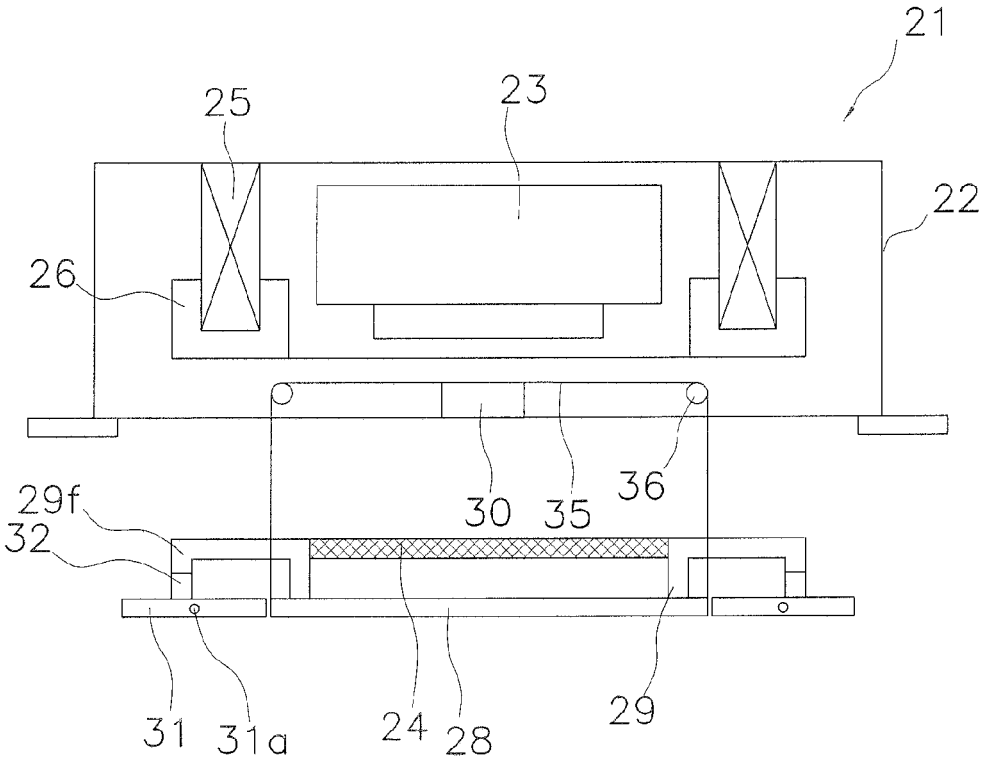
FIG. 14 is a cross-sectional view of a lowered state of the filter, the flat panel, and the moveable panels of the air conditioning apparatus in FIG. 12.

A ceiling-installed air conditioning apparatus 21 according to the second embodiment of the present invention has a configuration different from that of the first embodiment in that moveable panels 31 are raised and lowered together with a filter 24 and a flat panel 28, as shown in FIGS. 12 through 14. The configuration of the air conditioning apparatus 21 is described hereinbelow.

The air conditioning apparatus 21 is disposed in a state of being embedded in a ceiling C above a room or another such air conditioned space. The air conditioning apparatus 21 is configured primarily from a case 22, an air-blowing fan 23, a filter 24, a heat exchanger 25, a drain pan 26, a flat panel 28, a filter support part 29, a flat panel raising/lowering mechanism 30, moveable panels 31, and moveable-panel moving mechanisms 32.

The case 22 is inserted and disposed in an opening formed in the ceiling C of the room. Disposed inside the case 22 are, primarily, the air-blowing fan 23 for drawing air in the room into the case 22 and blowing the air peripherally outward, the filter 24 for filtering the air drawn into the case 22, and the heat exchanger 25 disposed so as to enclose the external periphery of the air-blowing fan 23.

The case 22 of the air conditioning apparatus 21 is disposed so as to fit into the opening of the ceiling C. The case 22 may also be disposed by being suspended from the surface of the ceiling C.

The air-blowing fan 23 is configured from a turbofan or another such centrifugal fan, in which the air in the room is drawn into the case 22 through suction ports 33 of the case 22 and an air flow is generated for blowing conditioned air out from discharge ports 34 after the air is filtered by the filter 24. The air drawn in through the suction ports 33 flows through the air-blowing fan 23 to the heat exchanger 25. In the heat exchanger 25, the air undergoes heat exchange with a refrigerant and is cooled or heated to become conditioned air. The conditioned air then flows along the inside surfaces of the case 22, and the air is then blown out through the discharge ports 34 into the room or other air-conditioned space.

The drain pan 26 for receiving drain water produced by condensation of moisture in the air in the heat exchanger 25 is disposed underneath the heat exchanger 25.

The flat panel 28 is a panel made of a synthetic resin for covering part of the open portion of the bottom surface of the case 22, and the flat panel 28 corresponds to the bottom surface flat panel of the present invention. A pair of hooks (not shown) for connecting with protuberances 29*c* of the filter support part 29 are formed at the both ends of the flat panel 28, similar to the flat panel 8 of the first embodiment.

Also formed at the both sides of the flat panel 28 are a pair of suction ports 33 for drawing in the air in the room. Furthermore, a pair of discharge ports 34 for blowing out conditioned air into the room from the case 22 interior are formed in the outer sides of the pair of suction ports 33. The discharge ports 34 may be provided with flaps for adjusting the angles at which conditioned air is blown out.

The filter support part 29 detachably supports the filter 24 such that the filter 24 is separated upward from the flat panel 28 by a predetermined gap t (see FIG. 13). Since the filter 24 is separated upward from the flat panel 28 by the predetermined gap t, it is possible to sufficiently ensure an air intake channel R.

The filter support part 29 detachably supports the filter 24 such that the filter 24 is separated upward from the flat panel 28 by the predetermined gap t.

The filter support part 29 has a pedestal 29*a*, support parts 29*b* for supporting the filter 24 from below, protuberances 29*c*, and connecting parts 29*f* connected to the moveable panels 31 and the moveable-panel moving mechanisms 32. The filter support part 29 detachably supports the filter 24 such that the support parts 29*b* and the frame portion of the filter 24 fit together.

Moreover, the filter support part 29 is detachably connected to the flat panel 28. The pair of hooks (not shown) formed at the both ends of the flat panel 28 detachably fit with the protuberances 29*c* of the filter support part 29, whereby the flat panel 28 can be easily attached and removed. The flat panel 28 can also be opened up to expose the filter 24, and as a result, it is therefore even easier to clean and replace the filter 24.

The flat panel raising/lowering mechanism 30 raises and lowers the flat panel 28 together with the moveable panels 31, the moveable-panel moving mechanisms 32, the filter 24, and the filter support part 29. The flat panel raising/lowering mechanism 30 has a motor and a reduction mechanism inside its main body, and the mechanism raises and lowers the flat panel 28 by moving wires 35 back and forth, the wires being connected to the both ends of the flat panel 28 (see FIG. 14). The flat panel raising/lowering mechanism 30 is fixed to a frame (not shown) in the interior of the case 22. The wires 35 are extended by a pulley 36 provided in the case 22 interior, in a manner that allows the wires to move back and forth within the case 22.

The pair of moveable panels 31 are flat plate-shaped members manufactured from a synthetic resin or the like, and are disposed on the both sides of the flat panel 28. The moveable panels 31 open and close the suction ports 33 and the discharge ports 34. The moveable panels 31 are connected to the connecting parts 29*f* of the filter support part 29 via the moveable-panel moving mechanisms 32.

The moveable-panel moving mechanisms 32 are mechanisms for moving the moveable panels 31 between first positions I and second positions II, as shown in FIGS. 12 and 13. The moveable-panel moving mechanisms 32 are connected to the connecting parts 29*f* of the filter support part 29. The moveable-panel moving mechanisms 32 are configured from step motors or the like, for example, and are fixed in the case 22 interior. When the air conditioning apparatus 21 begins to operate, the moveable-panel moving mechanisms 32 rotatably move the moveable panels 31 from the first positions I to the second positions II, the second positions being inclined by predetermined angles in relation to the ceiling C, and the suction ports 33 and discharge ports 34 are opened. When the air conditioning apparatus 21 stops operating, the moveable panels 31 are rotatably moved from the second positions II to the first positions I, and the suction ports 33 and discharge ports 34 are closed.

<Characteristics of Second Embodiment>

(1)

Since the ceiling-embedded air conditioning apparatus 21 of the second embodiment further comprises the moveable panels 31 for opening and closing the suction ports 33 and discharge ports 34, which are ventilation ports formed between the bottom surface of the case 22 and the flat panel 28, and the flat panel raising/lowering mechanism 30 raises and lowers the flat panel 28 together with the moveable panels 31, the moveable-panel moving mechanisms 32, the filter 24, and the filter support part 29, the filter 24 can be opened together with the flat panel 28 and the moveable panels 31, and it is even easier to replace the filter 24. Moreover, since the moveable panels 31 and the moveable-panel moving mechanisms 32 are also raised and lowered, maintenance is easily performed on the moveable panels 31 and the moveable-panel moving mechanisms 32.

(2)

Similar to the air conditioning apparatus 1 of the first embodiment, since the ceiling-embedded air conditioning apparatus 21 disposed in the ceiling C above the room in the second embodiment comprises the case 22 whose bottom surface is opened, the flat panel 28 for covering part of the open portion in the bottom surface of the case 22, the filter 24 accommodated within the case 22, and the filter support part 29 for detachably supporting the filter 24 such that the filter 24 is separated upward from the flat panel 28 by a predetermined gap t, the filter 24 can be opened together with the flat panel 28, and it is easy to replace the filter 24. Moreover, the filter 24 is separated upward from the flat panel 28 by the predetermined gap t by the filter support part 29, whereby an air intake channel R can be sufficiently ensured between the filter 24 and the flat panel 28.

(3)

In the air conditioning apparatus 21 of the second embodiment, similar to the air conditioning apparatus 1 of the first embodiment, since the filter support part 29 is detachably connected to the flat panel 28, the flat panel 28 can easily be attached to and removed from the filter support part 29, and the flat panel 28 can be opened up. The result is that it is even easier to clean and replace the filter 24. The flat panel 28 can also be easily cleaned and replaced.

(4)

Similar to the air conditioning apparatus 1 of the first embodiment, since the air conditioning apparatus 21 of the second embodiment further comprises the flat panel raising/lowering mechanism 30 for raising and lowering the flat panel 28 together with the filter 24 and the filter support part 29, the flat panel 28 and the filter 24 can be lowered to a height manageable for a worker, whereby the filter 24 can be easily cleaned and replaced.

(5)

In the air conditioning apparatus 21 of the second embodiment, similar to the air conditioning apparatus 1 of the first embodiment, since the suction ports 33 and the discharge ports 34, which are ventilation ports, are disposed in two locations facing each other across the flat panel 28 in the periphery of the flat panel 28 in the case 22 (a so-called double-flow arrangement), air can be drawn in and blown out in two directions in the room, and drafty feeling (breezy feeling) can be suppressed, making cooling, warming, and other types of air conditioning possible throughout the entire room.

<Modifications of Second Embodiment>

(A)

Figure 15:
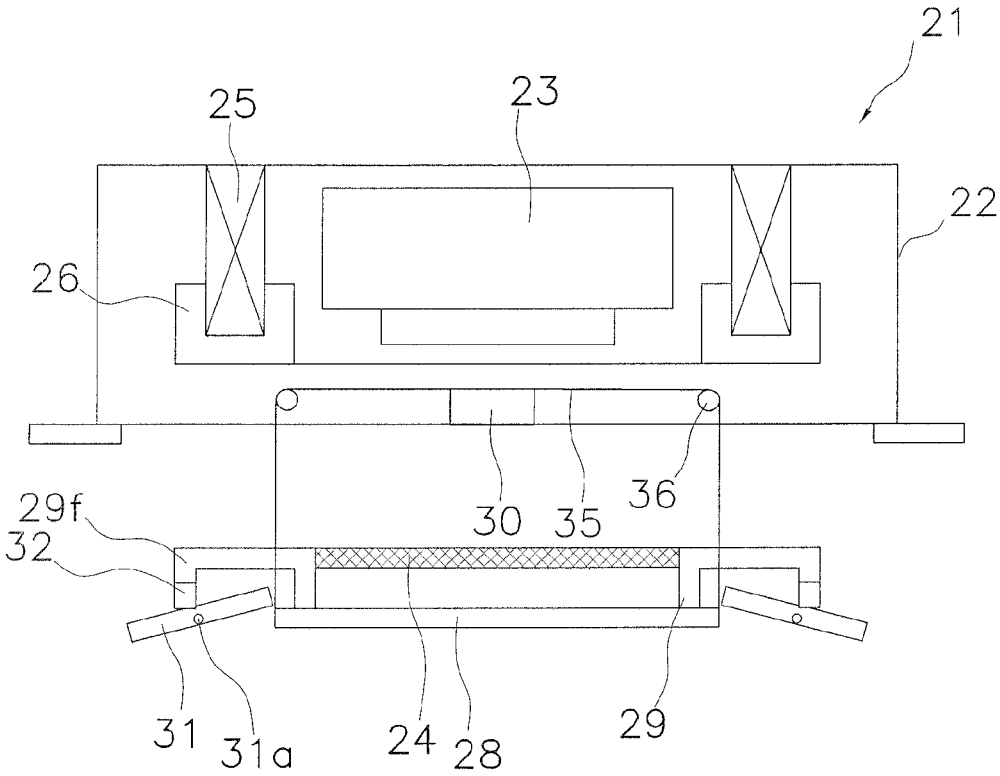
FIG. 15 is a cross-sectional view of a lowered state of the filter, the flat panel, and the moveable panels according to a modification of the second embodiment of the present invention.

In the air conditioning apparatus 21 of the second embodiment, the moveable panels 31 are raised and lowered together with the filter 24 and the flat panel 28 while the moveable panels 31 remain closed (the first position I in FIG. 12) as shown in FIG. 14, but the present invention is not limited to this option alone. As a modification of the second embodiment, the flat panel raising/lowering mechanism 30 may lower the flat panel 28 after the moveable panels 31 have opened, as shown in FIG. 15.

When the moveable panels 31 and the flat panel 28 are lowered using the wires 35, there are sometimes cases in which accurate vertical lowering is not possible due to the wobbling of the wires 35 and other such effects, and inconveniences may occur in which the moveable panels 31 are caught on the bottom surface of the case 22. In view of this, due to the flat panel raising/lowering mechanism 30 lowering the flat panel 28 after the moveable panels 31 have opened, it is possible to prevent inconveniences in which the moveable panels 31 are caught on the bottom surface of the case 22.

(B)

As yet another modification of the second embodiment, a so-called round flow arrangement may be used, wherein the suction ports 33 and discharge ports 34 are disposed around the entire periphery of the flat panel 28 constituting the bottom surface of the case 22.

In this case, air can be drawn in from and blown out in all directions in the room, and drafty feeling (breezy feeling) can be further suppressed, making cooling, warming, and other types of air conditioning possible throughout the entire room.

(C)

In the air conditioning apparatus 21 of the second embodiment, the flat panel raising/lowering mechanism 30 merely raises and lowers the flat panel 28 (as well as the moveable panels 31, the flat panel support part 29, and the filter 24) vertically, but the present invention is not limited to this option alone. As yet another modification of the second embodiment, the flat panel raising/lowering mechanism 30 may raise/lower and tilt the flat panel 28 by changing the feed amounts (strokes) of both side wires 35. In this case, the filter 24 can also be automatically inclined together with the flat panel 28, making it even easier to clean and replace the filter.

Third Embodiment

<Basic Configuration of Air Conditioning Apparatus 41>

A ceiling-installed air conditioning apparatus 41 according to the third embodiment of the present invention has a configuration differing from that of the first embodiment in that instead of the flat panel raising/lowering mechanism 10 of the first embodiment, the air conditioning apparatus 41 comprises a rotational opening/closing mechanism 61 for rotating and opening/closing a flat panel 48 downward in the bottom surface of a case 42 together with a filter 44, and a filter-raising/lowering mechanism 62 for separating the filter 44 from the flat panel 48 and raising/lowering the filter 44, as shown in FIGS. 16 through 19. The configuration of the air conditioning apparatus 41 is described hereinbelow.

The air conditioning apparatus 41 is disposed in a state of being embedded in a ceiling C above a room or another such air conditioned space. The air conditioning apparatus 41 is configured primarily from the case 42, an air-blowing fan 43, the filter 44, a heat exchanger 45, a drain pan 46, the flat panel 48, a filter support part 49, moveable panels 51, moveable-panel moving mechanisms 52, the rotational opening/closing mechanism 61, and the filter-raising/lowering mechanism 62.

The case 42 is inserted and disposed in an opening formed in the ceiling C of the room. Disposed inside the case 42 are, primarily, the air-blowing fan 43 for drawing air in the room into the case 42 and blowing the air peripherally outward, the filter 44 for filtering the air drawn into the case 42, and the heat exchanger 45 disposed so as to enclose the external periphery of the air-blowing fan 43.

The case 42 of the air conditioning apparatus 41 is disposed so as to fit into the opening of the ceiling C. The case 42 may also be disposed by being suspended from the surface of the ceiling C.

The air-blowing fan 43 is configured from a turbofan or another such centrifugal fan, the air in the room is drawn into the case 42 through suction ports 53 in the case 42, and an air flow is generated for blowing conditioned air out from discharge ports 54 after the air is filtered by the filter 44. The air drawn in through the suction ports 53 flows through the air-blowing fan 43 to the heat exchanger 45. In the heat exchanger 45, the air undergoes heat exchange with a refrigerant and is cooled, heated, or conditioned in another manner to create conditioned air. The conditioned air then flows along the inside surfaces of the case 42, and the air is then blown out through the discharge ports 54 into the room or other air-conditioned space.

The drain pan 46 for receiving drain water produced by condensation of moisture in the air in the heat exchanger 45 is disposed underneath the heat exchanger 45.

The flat panel 48 is a panel made of a synthetic resin for covering part of the open portion of the bottom surface of the case 42, and the flat panel 48 corresponds to the bottom surface flat panel of the present invention. A pair of hooks (not shown) for connecting with protuberances 49*c* of the filter support part 49 are formed at the both ends of the flat panel 48, similar to the flat panel 8 of the first embodiment. The hooks have the same shape as the hooks 8*a* in FIG. 5.

Also formed at the both sides of the flat panel 48 are a pair of suction ports 53 for drawing in the air in the room. Furthermore, a pair of discharge ports 54 for blowing out conditioned air into the room from the case 42 interior is formed in the outer sides of the pair of suction ports 53. The discharge ports 54 may be provided with flaps for adjusting the angles at which conditioned air is blown out.

Figure 17:
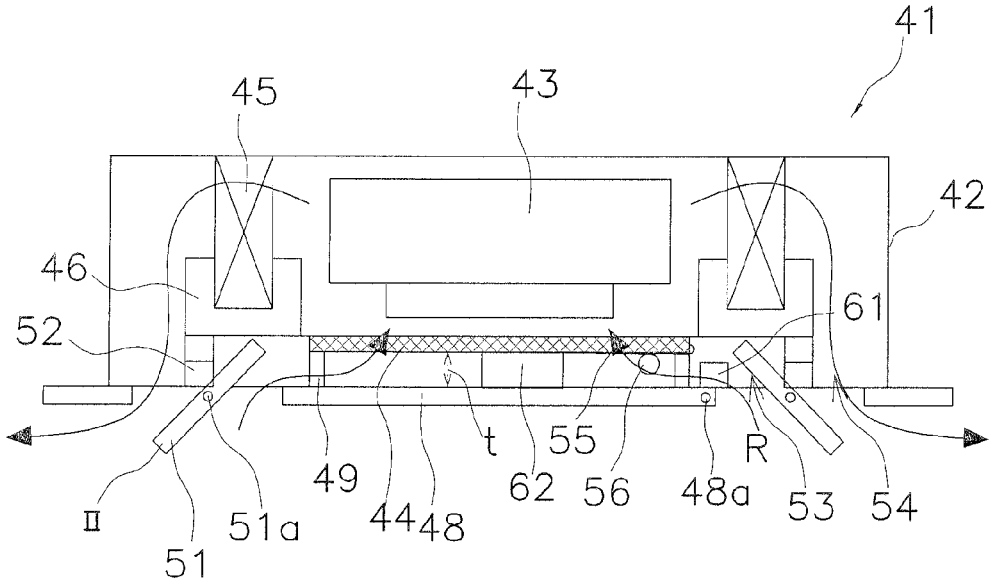
FIG. 17 is a cross-sectional view of an open state of the moveable panels of the air conditioning apparatus in FIG. 16.

The filter support part 49 detachably supports the filter 44 such that the filter 44 is separated upward from the flat panel 48 by a predetermined gap t (see FIG. 17). Since the filter 44 is separated upward from the flat panel 48 by the predetermined gap t, it is possible to sufficiently ensure an air intake channel R.

The filter support part 49 detachably supports the filter 44 such that the filter 44 is separated upward from the flat panel 48 by the predetermined gap t.

The filter support part 49 has a pedestal 49*a*, support parts 49*b* for supporting the filter 44 from below, and protuberances 49*c*. The filter support part 49 detachably supports the filter 44 such that the support parts 49*b* and the frame portion of the filter 44 fit together.

Moreover, the filter support part 49 is detachably connected to the flat panel 48. The pair of hooks (not shown) formed at the both ends of the flat panel 48 detachably fit with the protuberances 49*c* of the filter support part 49, whereby the flat panel 48 can be easily attached and removed. The flat panel 48 can also be opened up to expose the filter 44, and as a result, it is therefore even easier to clean and replace the filter 44.

Figure 18:
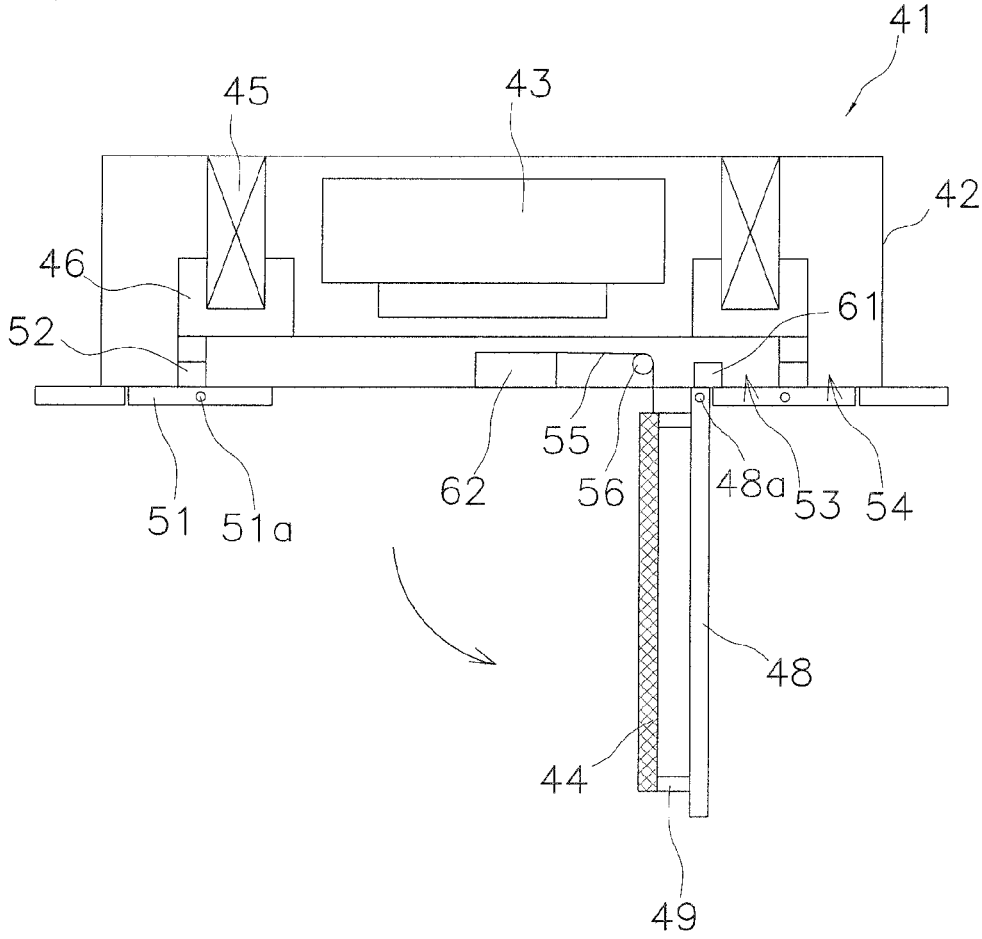
FIG. 18 is a cross-sectional view of a state in which the filter and flat panel of the air conditioning apparatus in FIG. 16 have been rotated and opened downward.

The rotational opening/closing mechanism 61 rotates and opens/closes the flat panel 48 downward in the bottom surface of the case 42. To be more specific, the rotational opening/closing mechanism 61 rotates the flat panel 48 together with the filter 44 around a rotational shaft 48*a*, as shown in FIG. 18. The rotational opening/closing mechanism 61 has a motor and a reduction mechanism in its interior, and the rotational opening/closing mechanism 61 provides rotational drive force to the flat panel 48.

The filter-raising/lowering mechanism 62 raises and lowers the filter 44. The filter-raising/lowering mechanism 62 has a motor and a reduction mechanism in its interior, and the filter-raising/lowering mechanism 62 raises and lowers the filter 44 by moving a wire 55 back and forth, the wire being connected to one end of the filter 44 (see FIG. 19). The filter-raising/lowering mechanism 62 is fixed to a frame (not shown) in the interior of the case 42. The wire 55 is extended by a pulley 56 provided in the case 42 interior, in a manner that allows the wire to move back and forth within the case 42.

Figure 19:
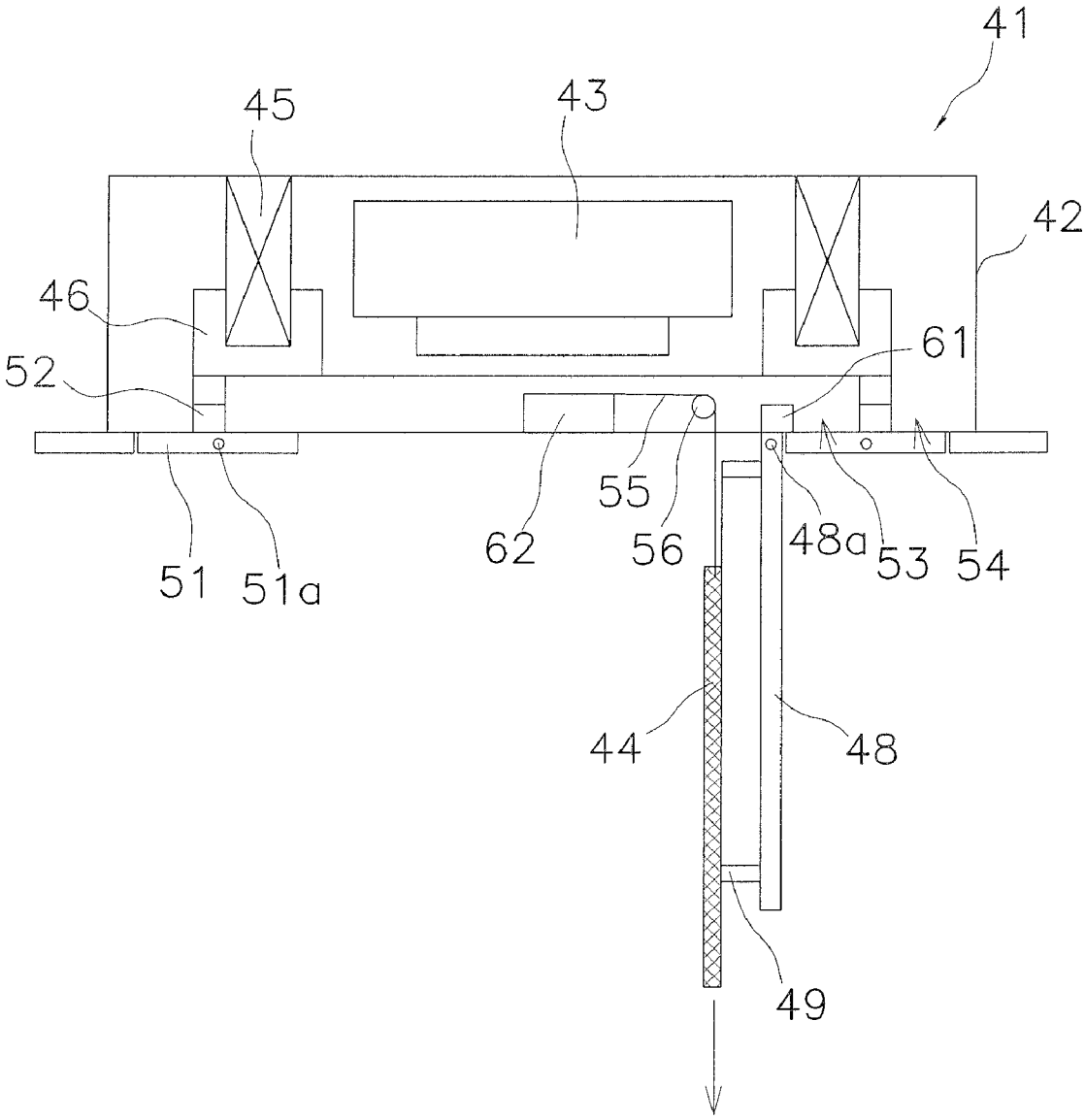
FIG. 19 is a cross-sectional view of a state in which the filter of the air conditioning apparatus in FIG. 16 has been lowered.

In cases of cleaning and replacing the filter 44, the flat panel 48 is rotated and opened downward together with the filter 44 by the rotational opening/closing mechanism 61 as shown in FIG. 18, and the filter 44 is then lowered to a predetermined height by the filter-raising/lowering mechanism 62 as shown in FIG. 19. It is therefore even easier to clean and replace the filter 44.

The pair of moveable panels 51 are flat plate-shaped members manufactured from a synthetic resin or the like, and are disposed on the both sides of the flat panel 48. The moveable panels 51 open and close the suction ports 53 and the discharge ports 54.

Figure 16:
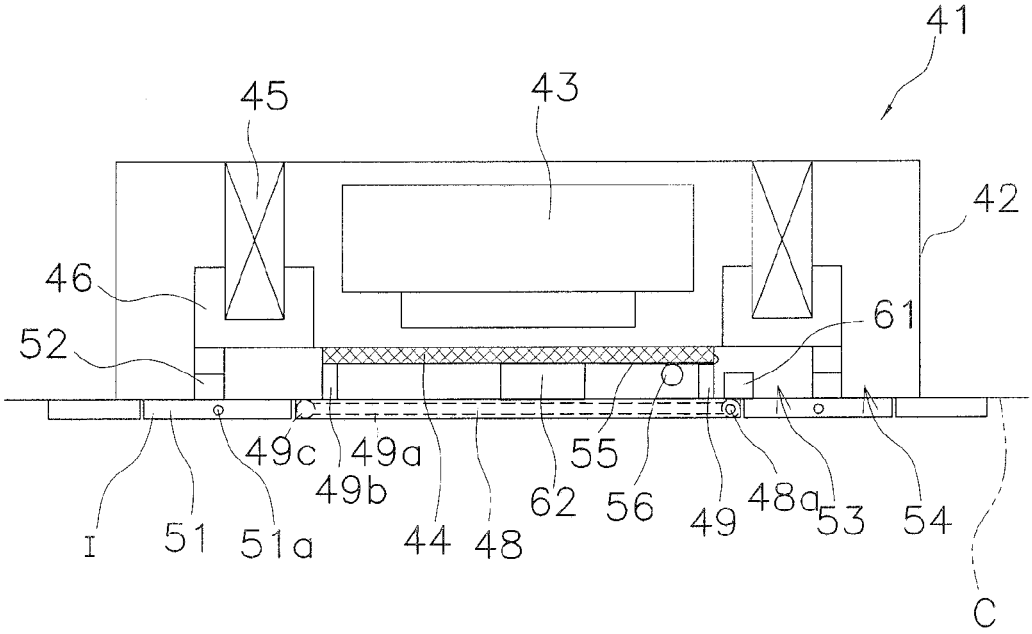
FIG. 16 is a cross-sectional view of a closed state of the moveable panels of the ceiling-installed air conditioning apparatus according to the third embodiment of the present invention.

The moveable-panel moving mechanisms 52 are mechanisms for moving the moveable panels 51 between first positions I and second positions II, as shown in FIGS. 16 and 17. The moveable-panel moving mechanisms 52 are configured from step motors or the like, for example, and are fixed in the case 42 interior. When the air conditioning apparatus 41 begins to operate, the moveable-panel moving mechanisms 52 rotatably move the moveable panels 51 from the first positions I to the second positions II, the second positions being inclined by predetermined angles in relation to the ceiling C, and the suction ports 53 and discharge ports 54 are opened. When the air conditioning apparatus 41 stops operating, the moveable panels 51 are rotatably moved from the second positions II to the first positions I, and the suction ports 53 and discharge ports 54 are closed.

<Characteristics of Third Embodiment>

(1)

Since the ceiling-embedded air conditioning apparatus 41 of the third embodiment further comprises the rotational opening/closing mechanism 61 for rotating and opening/closing the flat panel 48 downward in the bottom surface of the case 42, and the filter-raising/lowering mechanism 62 for separating the filter 44 from the flat panel 48, it is possible to raise and lower the filter 44 alone, and it is even easier to clean and replace the filter 44.

(2)

Similar to the air conditioning apparatus 1 of the first embodiment, since the ceiling-embedded air conditioning apparatus 41 disposed in the ceiling C above the room in the third embodiment comprises the case 42 whose bottom surface is opened, the flat panel 48 for covering part of the open portion in the bottom surface of the case 42, the filter 44 accommodated within the case 42, and the filter support part 49 for detachably supporting the filter 44 such that the filter 44 is separated upward from the flat panel 48 by a predetermined gap t, the filter 44 can be opened together with the flat panel 48, and it is easy to replace the filter 44. Moreover, the filter 44 is separated upward from the flat panel 48 by the predetermined gap t by the filter support part 49, whereby an air intake channel R can be sufficiently ensured between the filter 44 and the flat panel 48.

(3)

In the air conditioning apparatus 41 of the third embodiment, similar to the air conditioning apparatus 1 of the first embodiment, since the filter support part 49 is detachably connected to the flat panel 48, the flat panel 48 can easily be attached to and removed from the filter support part 49, and the flat panel 48 can be opened up. The result is that it is even easier to clean and replace the filter 44. The flat panel 48 can also be easily cleaned and replaced.

(4)

In the air conditioning apparatus 41 of the third embodiment, similar to the air conditioning apparatus 1 of the first embodiment, since the suction ports 53 and the discharge ports 54, which are ventilation ports, are disposed in two locations facing each other across the flat panel 48 in the periphery of the flat panel 48 in the case 42 (a so-called double-flow arrangement), air can be drawn in and blown out in two directions in the room, and drafty feeling (breezy feeling) can be suppressed, making cooling, warming, and other types of air conditioning possible throughout the entire room.

<Modifications of Third Embodiment>

(A)

As a modification of the third embodiment, a so-called round flow arrangement may be used, wherein the suction ports 53 and discharge ports 54 are disposed around the entire periphery of the flat panel 48 constituting the bottom surface of the case 42.

In this case, air can be drawn in from and blown out in all directions in the room, and drafty feeling (breezy feeling) can be further suppressed, making cooling, warming, and other types of air conditioning possible throughout the entire room.

INDUSTRIAL APPLICABILITY

The present invention can be broadly applied to ceiling-installed air conditioning apparatuses in which a filter is accommodated within a case. Therefore, the present invention is applicable not only to ceiling-embedded air conditioning apparatuses, but also to ceiling-suspended air conditioning apparatuses.

What is claimed is:

1. An air conditioning apparatus disposed above an air conditioned space, the air conditioning apparatus comprising:

a case having a bottom surface having an open portion;

a bottom surface panel covering part of the open portion of the bottom surface of the case;

a filter being accommodated in the case;

a filter support part detachably supporting the filter, the filter being separated upward from the bottom surface panel by a predetermined gap; and moveable panels formed between the bottom surface of the case and the bottom surface panel, the movable panels being arranged to open and close ventilation ports and to be substantially flush with the bottom surface panel when closed.

2. The air conditioning apparatus as recited in claim 1, wherein the filter support part is detachably connected to the bottom surface panel.

3. The air conditioning apparatus as recited in claim 2, further comprising a bottom surface panel raising/lowering mechanism that raises and lowers the bottom surface panel together with the filter and the filter support part.

4. The air conditioning apparatus as recited in claim 3, wherein the bottom surface panel raising/lowering mechanism raises and lowers the bottom surface panel together with the moveable panels, the filter, and the filter support part.

5. The air conditioning apparatus as recited in claim 4, wherein the bottom surface panel raising/lowering mechanism lowers the bottom surface panel after the moveable panels have opened.

6. The air conditioning apparatus as recited in claim 5, wherein the bottom surface panel raising/lowering mechanism raises/lowers and tilts the bottom surface panel.

7. The air conditioning apparatus as recited in claim 6, wherein the filter support part has fall-prevention parts that prevent the filter from falling when the bottom surface panel has been inclined.

8. The air conditioning apparatus as recited in claim 1, further comprising a rotational opening/closing mechanism that rotates and opens and closes the bottom surface panel downward in the bottom surface of the case, and a filter-raising/lowering mechanism that detaches the filter from the bottom surface panel, and raises and lowers the filter.

9. The air conditioning apparatus as recited in claim 1, wherein the ventilation ports are disposed around the periphery of the bottom surface panel in the case, at two opposing locations on opposite sides of the bottom surface panel.

10. The air conditioning apparatus as recited in claim 1, wherein the ventilation ports are disposed around the entire periphery of the bottom surface panel in the case.

11. The air conditioning apparatus as recited in claim 10, wherein the bottom surface panel raising/lowering mechanism raises and lowers the bottom surface panel together with the moveable panels, the filter, and the filter support part.

12. The air conditioning apparatus as recited in claim 11, wherein the bottom surface panel raising/lowering mechanism lowers the bottom surface panel after the moveable panels have opened.

13. The air conditioning apparatus as recited in claim 1, further comprising a bottom surface panel raising/lowering mechanism that raises and lowers the bottom surface panel together with the filter and the filter support part.

14. The air conditioning apparatus as recited in claim 13, wherein the bottom surface panel raising/lowering mechanism raises/lowers and tilts the bottom surface panel.

15. The air conditioning apparatus as recited in claim 14, wherein the filter support part has fall-prevention parts that prevent the filter from falling when the bottom surface panel has been inclined.

16. An air conditioning apparatus disposed above an air conditioned space, the air conditioning apparatus comprising:

a case having a bottom surface having an open portion;

a bottom surface panel covering part of the open portion of the bottom surface of the case;

a filter being accommodated in the case;

a filter support part detachably supporting the filter, the filter being separated upward from the bottom surface panel by a predetermined gap;

moveable panels formed between the bottom surface of the case and the bottom surface panel, the movable panels being arranged to open and close ventilation ports, and the movable panels being arranged such that, when open, the movable panels overlap horizontally with the filter.

17. The air conditioning apparatus as recited in claim 16, wherein the filter support part is detachably connected to the bottom surface panel.

18. The air conditioning apparatus as recited in claim 17, further comprising a bottom surface panel raising/lowering mechanism that raises and lowers the bottom surface panel together with the filter and the filter support part.

19. The air conditioning apparatus as recited in claim 18, wherein the bottom surface panel raising/lowering mechanism raises and lowers the bottom surface panel together with the moveable panels, the filter, and the filter support part.

20. The air conditioning apparatus as recited in claim 19, wherein the bottom surface panel raising/lowering mechanism lowers the bottom surface panel after the moveable panels have opened.

21. The air conditioning apparatus as recited in claim 20, wherein the bottom surface panel raising/lowering mechanism raises/lowers and tilts the bottom surface panel.

22. The air conditioning apparatus as recited in claim 21, wherein the filter support part has fall-prevention parts that prevent the filter from falling when the bottom surface panel has been inclined.

23. The air conditioning apparatus as recited in claim 16, further comprising a rotational opening/closing mechanism that rotates and opens and closes the bottom surface panel downward in the bottom surface of the case, and a filter-raising/lowering mechanism that detaches the filter from the bottom surface panel, and raises and lowers the filter.

24. The air conditioning apparatus as recited in claim 16, wherein the ventilation ports are disposed around the periphery of the bottom surface panel in the case, at two opposing locations on opposite sides of the bottom surface panel.

25. The air conditioning apparatus as recited in claim 16, wherein the ventilation ports are disposed around the entire periphery of the bottom surface panel in the case.

26. The air conditioning apparatus as recited in claim 16, further comprising a bottom surface panel raising/lowering mechanism that raises and lowers the bottom surface panel together with the filter and the filter support part.

27. The air conditioning apparatus as recited in claim 26, wherein the bottom surface panel raising/lowering mechanism raises and lowers the bottom surface panel together with the moveable panels, the filter, and the filter support part.

28. The air conditioning apparatus as recited in claim 27, wherein the bottom surface panel raising/lowering mechanism lowers the bottom surface panel after the moveable panels have opened.

29. The air conditioning apparatus as recited in claim 26, wherein the bottom surface panel raising/lowering mechanism raises/lowers and tilts the bottom surface panel.

30. The air conditioning apparatus as recited in claim 29, wherein the filter support part has fall-prevention parts that prevent the filter from falling when the bottom surface panel has been inclined.

* * * * *